United States Patent [19]

Chang

[11] Patent Number: 4,552,269

[45] Date of Patent: Nov. 12, 1985

[54] RESEALABLE SEALING DEVICE

[76] Inventor: Sung-Chol Chang, 101 W. 31st St., Suite 2306, New York, N.Y. 10001

[21] Appl. No.: 558,989

[22] Filed: Dec. 7, 1983

[51] Int. Cl.[4] ..... B65D 33/16; B65D 33/20

[52] U.S. Cl. ..... 206/632

[58] Field of Search ..... 206/632, 626; 220/258, 220/359; 383/903, 120; 229/7 S

[56] References Cited

U.S. PATENT DOCUMENTS

| | | | |
|---|---|---|---|
| 1,944,621 | 1/1934 | Van Atta | 383/903 |
| 1,997,378 | 4/1935 | Driver | 383/903 |
| 2,719,663 | 10/1955 | Meyer-Jagenberg | 206/626 |
| 2,896,839 | 7/1959 | Barnes et al. | 206/626 |
| 3,035,754 | 5/1962 | Meister | 383/120 |
| 3,358,903 | 12/1967 | Stefano et al. | 383/120 |
| 3,687,352 | 8/1972 | Kalajian | 206/626 |
| 3,711,011 | 1/1973 | Kugler | 383/66 |
| 4,192,420 | 3/1980 | Worrell et al. | 220/258 |
| 4,197,949 | 4/1980 | Carlsson | 206/626 |
| 4,260,061 | 4/1981 | Jacobs | 206/632 |
| 4,420,080 | 12/1983 | Nakamura | 206/621 |

*Primary Examiner*—Stephen P. Garbe

*Attorney, Agent, or Firm*—Richard L. Miller

[57] ABSTRACT

A container with a resealable sealing device consisting of a paper of foil blank and a sealing flap which can be produced inexpensively by means of die cutting. A pressure sensitive adhesive is used to make the sealing flap of the container resealable and the sealing flap is attached in a strong yet flexible manner. Die cut tear prevention holes are used to prevent the sealing flap from tearing away from the container.

2 Claims, 4 Drawing Figures

RESEALABLE SEALING DEVICE

BACKGROUND OF THE INVENTION

The present invention relates generally to sealing devices which may be resealed after use. It is often necessary to provide an inexpensive container in which the contents of the container are protected by a trouble free reusable seal. Previous attempts at producing such a container have had several shortcomings. First, the previous attempts have required complex systems with numerous components each requiring expensive die cutting in manufacture. Second, the resealing system was unreliable in that after a limited umber of re-closures the seal often failed to close or adhere. Additionally the sealing component of the container was often a separate component which would become dislodged and thereupon misplaced by the user.

SUMMARY OF THE INVENTION

Therefore, it is a principle object of the present invention to provide a resealable container with only two major components: a paper or foil blank with a single die cut and a sealing flap. This combination may be manufactured simply and inexpensively and combined to form a resealable container.

A second object is to provide a reliable flap seal which may be used a large number of times before failing to seal.

Another object is to attach the sealing component to the container in such a manner as to make separation of the sealing component from the container unlikely.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
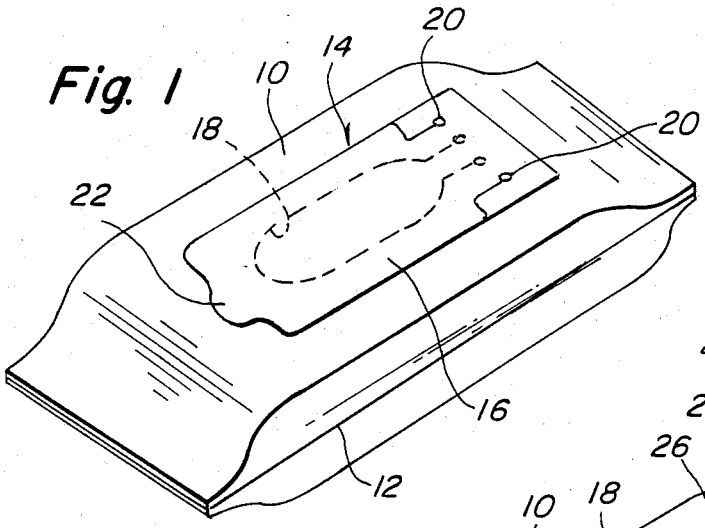
FIG. 1 is a perspective view of the invention shown in a sealed position.

Referring now to the drawings, FIG. 1 represents the invention shown in a sealed position. The resealable sealing device consists of a pouch 10 shown with an accordion fold 12 to allow for expansion of pouch 10 with insertion of contents and contraction with withdrawal of contents. A reusable seal 14 is shown whose sealing flap 16 covers container opening 18 in order to seal the container. Sealing flap tear prevention holes 20 are provided at the edges of the sealing flap's line of attachment to relieve stress at this point and prevent tearing. A finger grip 22 allows the user to lift the tongue 16 in order to open the container.

Figure 2:
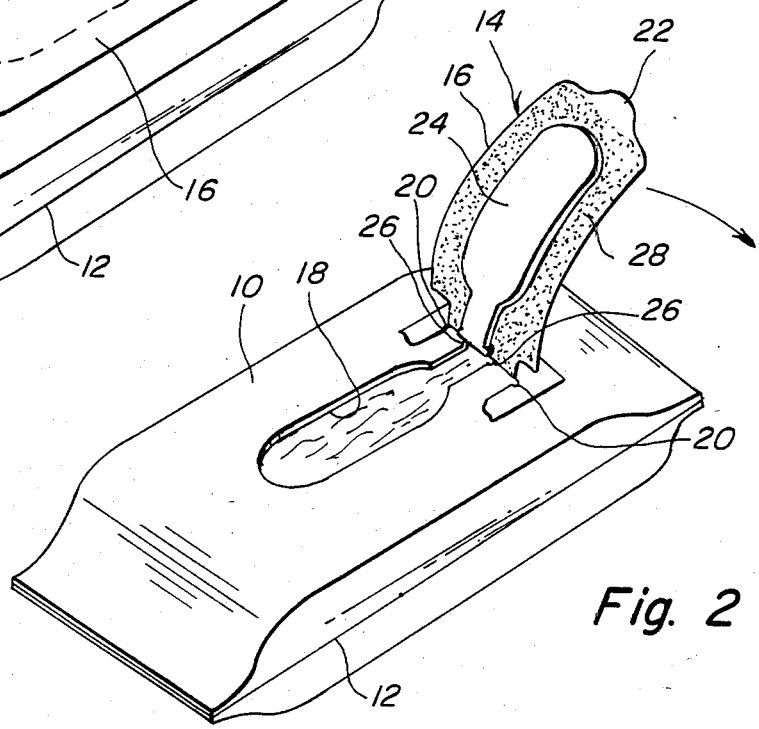
FIG. 2 is a similar view shown in an open position.

In FIG. 2 the invention is shown in an open position where opening 18 can be clearly seen. With the reusable seal 14 in the open position, inner flap 24 is visible with its inner flap tear prevention holes 26. A pressure-sensitive adhesive 28 is applied to the bottom surface of sealing flap 16 so that the pouch may be repeatedly sealed and resealed.

Figure 3:
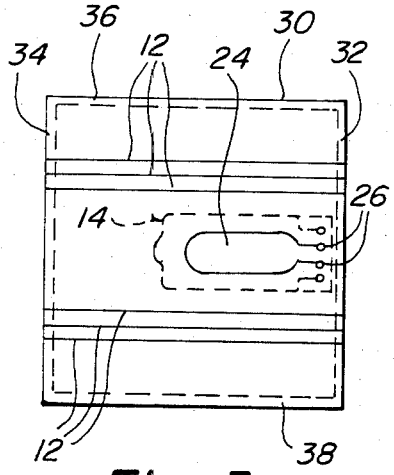
FIG. 3 is a top view of the container blank shown after die cutting but before folding with the sealing flap shown superimposed in dotted line.

FIG. 3 represents the blank 30 which is cut into a rectangular shape. Accordion folds 12 are shown in detail. An inner flap 24 and two inner flap tear prevention holes 26 are die cut into blank 30. In order to form a container, after accordion folds 12 are made, the top edge is secured by means of permanent adhesive along top seam line 32, the bottom edge is secured by means of permanent adhesive along bottom seam line 34, and the rear seam is formed by bringing together rear seal line 36 and rear seal line 38 and securing with a permanent adhesive. After the container is formed, reusable seal 14, shown in dotted line, is attached by means of a pressure sensitive adhesive.

Figure 4:
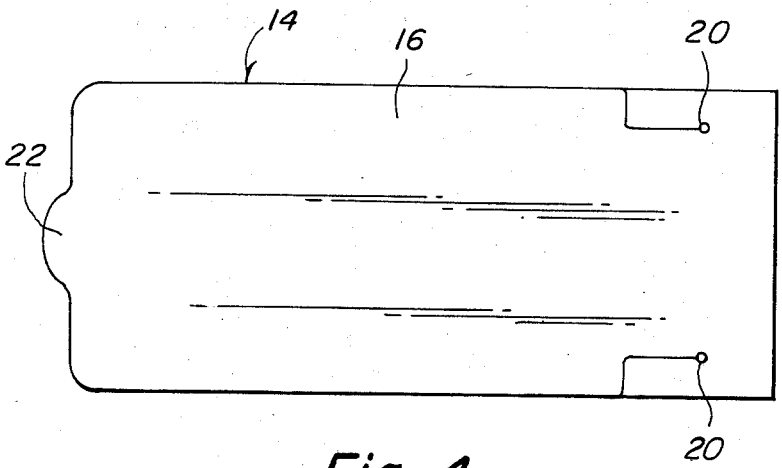
FIG. 4 is an enlarged top view of the sealing flap per se.

FIG. 4 is an enlarged top view of the sealing flap 16 showing two sealing flap tear prevention holes 20. It is to be noted that sealing flap 16 an inner flap 24 are joined adhesively and that the line joining holes 20—20 is colinear with the line formed by holes 26—26. This arrangement allows the reusable seal 14 to be flexible while making the separation of the sealing flap 16 from the pouch 10 unlikely.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container with a resealable sealing device, comprising in combination, a container having an outer surface, an elongated inner flap, and an elongated sealing flap overlying said inner flap, said inner flap having a periphery with a forward and rearward portion, the forward portion of said periphery being cut out from said surface and terminating at said rearward portion, the rearward portion of said periphery being integrally attached to said surface along a line of attachment, said inner flap being pivotally liftable with respect to said outer surface along said line of attachment, said sealing flap having adhesive applied along one surface thereof and being attached onto said inner flap by means of said adhesive, said sealing flap being larger than said inner flap so as to define a peripheral border around said inner flap, said peripheral border including a front border portion, side border portions and a rear border portion, the rear border portion overlapping the rearward portion of said periphery of the inner flap, and being permanently attached to the outer surface of the container by means of said adhesive, a pair of opposing L-shaped cuts formed into said sealing flap commencing from opposing side edges thereof and partially extending into said side border portions of said sealing flap and then extending rearwardly toward the permanently attached rear border portion and terminating at said line of attachment, a first pair of tear prevention holes formed at the termination of said L-shaped cuts, and a second pair of tear prevention holes formed at the termination of said forward portion peripheral cut of said inner flap, all said tear prevention holes lying on said line of attachment, whereby said sealing flap can be pivotally lowered to replace said inner flap into its cut out and thereby seal the container by having the front border portion and the side border portions of said peripheral border of the sealing flap adhere to the container outer surface by means of said adhesive, and can pivotally be lifted to open the container without the permanently attached rear border portion lifting off and without said inner flap being detached.

2. A container as in claim 1, wherein the peripheral cut about said inner flap terminates in a pair of rearwardly extending portions parallel to the rearwardly extending cuts in said sealing flap.

* * * * *